US006538372B2

(12) United States Patent
Vose et al.

(10) Patent No.: US 6,538,372 B2
(45) Date of Patent: Mar. 25, 2003

(54) FLUORESCENT AGRO LAMP WITH REDUCED MERCURY

(75) Inventors: Kelly S. Vose, Latrobe, PA (US); Brett A. Carter, Salina, KS (US); Emmanuel W. J. L. Oomen, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 84 days.

(21) Appl. No.: 09/739,471

(22) Filed: Dec. 18, 2000

(65) Prior Publication Data

US 2002/0113541 A1 Aug. 22, 2002

(51) Int. Cl.[7] ..... H01J 1/62
(52) U.S. Cl. ..... 313/486; 313/487; 315/209 R
(58) Field of Search ..... 313/486, 489, 313/491, 485, 487; 315/246, 291, 209 R; 345/47

(56) References Cited

U.S. PATENT DOCUMENTS 3,599,029 A * 8/1971 Martyny ..... 313/185
3,748,517 A 7/1973 Haft ..... 313/109
3,860,852 A * 1/1975 Latassa et al. ..... 313/490
4,705,986 A * 11/1987 Iwama et al. ..... 313/487
5,714,836 A 2/1998 Hunt et al. ..... 313/487
5,838,101 A * 11/1998 Pappalardo ..... 313/486
5,917,291 A * 6/1999 Soules et al. ..... 315/248
6,400,097 B1 * 6/2002 Jin et al. ..... 315/246

FOREIGN PATENT DOCUMENTS

EP 0385275 A3 9/1990 ..... H01J/61/38
EP 0385275 A2 9/1990 ..... H01J/61/38

* cited by examiner

*Primary Examiner*—David Vu
*Assistant Examiner*—Jimmy T. Vu
(74) *Attorney, Agent, or Firm*—Frank Keegan

(57) ABSTRACT

An electric lamp has an envelope with an inner surface and two electrodes located at each end of the envelope. The electrodes transfer electric power to generate ultraviolet radiation in the envelope which is filled with mercury and a charge sustaining gas. The inner surface of the envelope is pre-coated with an aluminum oxide layer to reflect ultraviolet radiation back into the envelope. A phosphor layer is formed over the aluminum oxide to convert the ultraviolet radiation to visible light. The phosphor layer is a mixture of three phosphors, namely, Barium Magnesium Aluminate, Cerium Gadolinium Magnesium Borate, and Calcium Halophosphor.

21 Claims, 2 Drawing Sheets

FLUORESCENT AGRO LAMP WITH REDUCED MERCURY

BACKGROUND OF THE INVENTION

1. Field of the Invention

The present invention is directed to low pressure mercury vapor lamps, more commonly known as fluorescent lamps, having a lamp envelope with phosphor coating, and more particularly, to a coating with three phosphors over an alumina pre-coat.

2. Discussion of the Prior Art

Low pressure mercury vapor lamps, more commonly known as fluorescent lamps, have a lamp envelope with a filling of mercury and rare gas to maintain a gas discharge during operation. The radiation emitted by the gas discharge is mostly in the ultraviolet (UV) region of the spectrum, with only a small portion in the visible spectrum. The inner surface of the lamp envelope has a luminescent coating, often a blend of phosphors, which emits visible light when impinged by the ultraviolet radiation. Special fluorescent lamps are used in horticulture and are referred to as "Agro" or "Agro-Lite" lamps.

Agro lamps used in horticulture contain phosphors that simulate the photoperiod of daylight or of natural light. The Agro lamps are used for growing plants indoors and have been developed with phosphors that closely match the absorption spectra of chlorophyll. The phosphors of Agro lamps are rich in the blue and red regions of the spectrum since plants use blue light (approximately 450 nm) for root growth, and red light (approximately 600–700 nm) for photosynthesis, stem growth, flowering and chlorophyll production. The blue/violet light also inhibits bacteria and growth of molds.

The phosphors of conventional Agro lamps are high mercury consumers and cannot pass the Toxicity Characteristic Leaching Procedure (TCLP) test without sacrificing lamp life. Accordingly, there is a drive to reduce mercury consumption in Agro fluorescent lamps without a reduction in the lamp life.

To increase efficiency and reduce mercury consumption without a reduction in the lamp life, different blends of phosphors are used for the luminescent coating. Further, a metal oxide layer is provided between the luminescent coating and glass envelope. The metal oxide layer reflects the UV radiation back into the phosphor luminescent layer through which it has already passed for further conversion of the UV radiation to visible light. This improves phosphor utilization and enhances light output. The metal oxide layer also reduces mercury consumption by reducing mercury bound at the tubular portion of the lamp.

Desirable fluorescent lamps characteristics include high brightness and high color rendering. Conventional Agro lamps have a correlated color temperature of 2450 K, with a CRI greater than 80. In particular, a conventional Agro lamp is made with a two-phosphor mixture of Strontium Magnesium Phosphor (Sr. Mag), i.e., $(Sr,Mg)_3(PO_4)_2$:Sn, and Strontium Chloroapatite (SCAP), i.e., $Sr_5Cl(PO_4)_3$:Eu. The Sr. Mag is very rich in the red region of the spectrum and the SCAP provides the Agro lamp with the blue light source.

These phosphors are detrimental for mercury consumption. In particular, Sr. Mag is the highest consumer of mercury and its high percentage renders the conventional Agro lamps non-TCLP compliant.

Accordingly, there is a need for fluorescent Agro lamps with high CRI and reduced mercury that pass TCLP.

SUMMARY OF THE INVENTION

The object of the present invention is to provide fluorescent Agro lamps with high CRI and reduced mercury consumption.

The present invention accomplishes the above and other objects by providing an electric lamp having an envelope with an inner surface and at least one electrode, such as two electrodes located at both ends of the envelope tube. The electrodes transfer electric power to generate ultraviolet radiation in the envelope which is filled with mercury and a charge sustaining gas. The inner surface of the envelope is pre-coated with a metal oxide layer, such as an aluminum oxide layer, to reflect ultraviolet radiation back into the envelope.

A phosphor layer is formed over the aluminum oxide to convert the ultraviolet radiation to visible light. The phosphor layer is a mixture of three phosphors, namely, blue luminescing Barium Magnesium Aluminate (BAM), red-luminescing Cerium Gadolinium Magnesium Borate (CBTM), and 3000 K-luminescing Calcium Halophosphor, also referred to as Warm White (WW).

BRIEF DESCRIPTION OF THE DRAWINGS

Further features and advantages of the invention will become more readily apparent from a consideration of the following detailed description set forth with reference to the accompanying drawings, which specify and show preferred embodiments of the invention, wherein like elements are designated by identical references throughout the drawings; and in which.

DETAILED DESCRIPTION OF THE INVENTION

Figure 1:
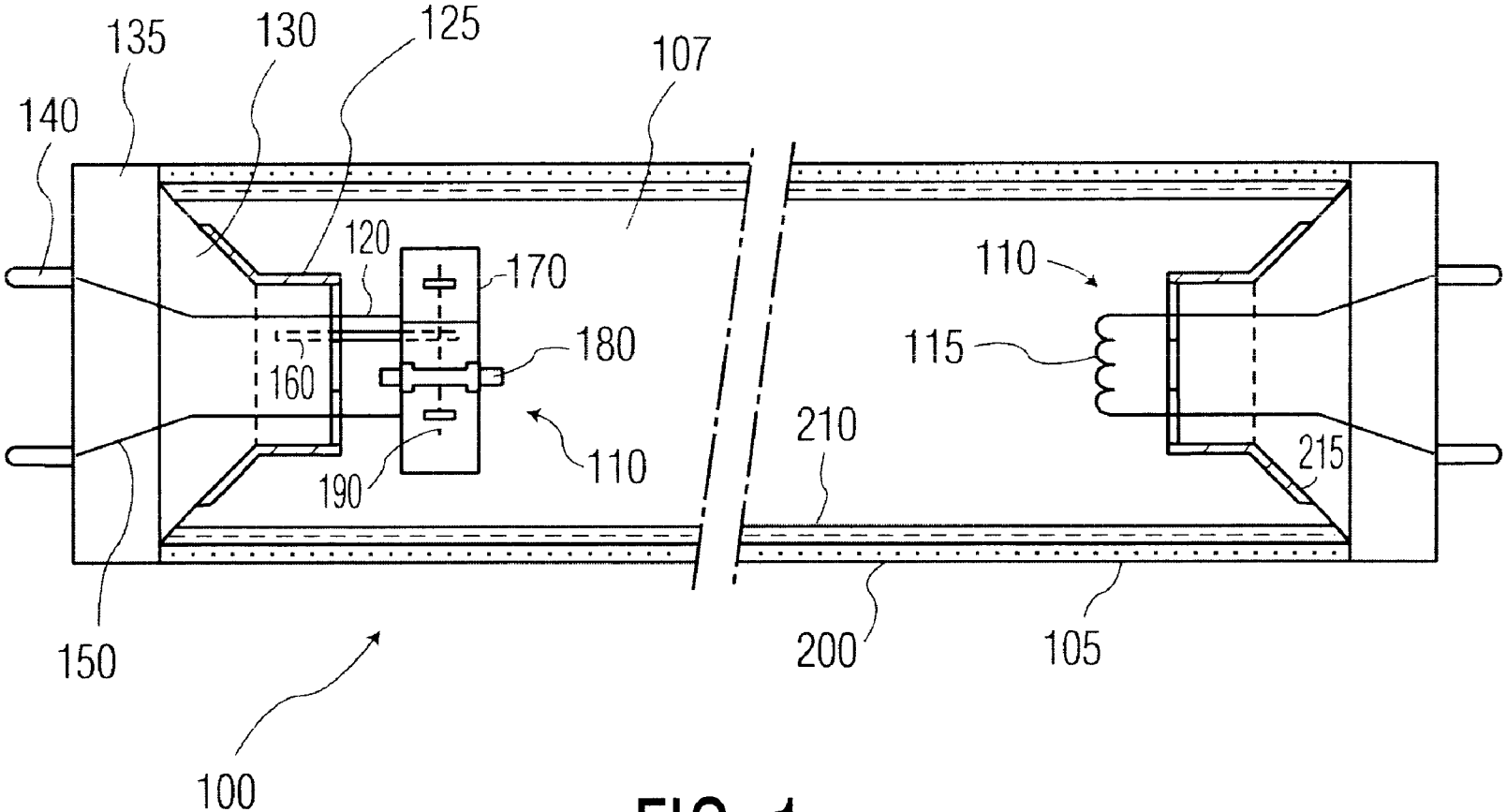
FIG. 1 shows an Agro fluorescent lamp according to present invention.

FIG. 1 shows a low-pressure mercury vapor discharge or fluorescent lamp 100 with an elongated outer envelope 105 which encloses a discharge space 107 in a gastight manner. The lamp 100 shown in the illustrative example of FIG. 1 is tubular lamp, preferably having a length of approximately 0.5 to 8 feet long, operating on a current from approximately 0.160 to 1.500 Amps, and a lamp power approximately from 4.0 to 215 Watts, for example. However, the lamp may be a compact fluorescent lamp, and the lamp may have other operating parameters and have other shapes like curved shapes, such as U-shape or circular, or any other desired shape.

Illustratively, the lamp 100 has a conventional electrode structure 110 at each end which includes a filament 115 made of tungsten, for example. Alternatively, the electrode structure 110 may be provided at only a single end, particularly for compact fluorescent lamps. The electrode structure 110 is not the essence of the present invention, and other structures may be used for lamp operation to generate and maintain a discharge in the discharge space 107. For example, a coil positioned outside the discharge space 107 may be used to generate an alternating magnetic field in the discharge space for generating and maintaining the discharge.

Returning to the illustrative lamp 100 of FIG. 1, the filament 115 of the electrode structure 110 is supported on conductive lead wires 120 which extend through a glass press seal 125 located at one end of a mount stem 130 near the base 135 of the lamp 100. The leads 120 are connected to pin-shaped contacts 140 of their respective bases 135 fixed at opposite ends of the lamp 100 though conductive feeds 150.

A center lead wire 160 extends from each mount 130 through each press seal 125 to support a cathode ring 170 positioned around the filament 115. A glass capsule 180 with which mercury was dosed is clamped on the cathode ring 170 of only one of the mounts 130. The other mount does not contain a mercury capsule, however a cathode guard 170 may be provided around its filament 115, which has been omitted in FIG. 1 in order to show the filament 115.

A metal wire 190 is tensioned over the mercury glass capsule 180. The metal wire 190 is inductively heated in a high frequency electromagnetic field to cut open the capsule 180 for releasing mercury into the discharge space 107 inside the envelope 105.

The discharge space 107 enclosed by the envelope 105 is filled with an ionizable discharge-sustaining filling which includes an inert gas such as argon, or a mixture of argon and other gases, at a low pressure. The inert gas and a small quantity of mercury sustain an arc discharge during lamp operation. In the operation of the lamp 100, when the electrodes 110 are electrically connected to a source of predetermined energizing potential via the contact pins 150, a gas discharge is sustained between the electrodes 110 inside the envelope 105. The gas discharge generates ultraviolet (UV) radiation which is converted to visible light by a phosphor luminescent layer shown as numeral 210 in FIG. 1.

In particular, the inner surface of the outer envelope 105 is pre-coated with a single layer of a metal oxide, such as aluminum oxide $Al_2O_3$ 200, over which a phosphor luminescent layer 210 is formed. The alumina pre-coat 200 reflects the UV radiation back into the phosphor luminescent layer 210 through which it has already passed for further conversion of the UV radiation to visible light. This improves phosphor utilization and enhances light output. The alumina pre-coat 200 also reduces mercury consumption by reducing mercury diffusion into the glass lamp envelope 105. To further reduce mercury consumption, the glass mount stems 130 and press seals 125 may also be coated with an alumina pre-coat layer 215, to reduce mercury bound to the glass mount stems 130 and press seals 125.

The alumina pre-coat layer 200 is applied by liquid suspension according to commonly employed techniques for applying phosphor layers on the inner surface of the lamp envelope 105. For example, aluminum oxide is suspended in a water base solution and flushed down the lamp tube or envelope 105 to flow over the envelope inner surface until it exits from the other end. The solution is dried in a drying chamber and then the phosphor coat 210 is applied in a similar fashion and sintered or baked for a period of time.

The alumina pre-coat layer 215 may be formed over the glass mount stems 130 and press seals 125 by methods well known in the art, such as by painting the glass mount stems 130 and press seals 125 with the water solution containing suspended aluminum oxide, followed by drying and sintering.

The phosphor coat 210 comprises a mixture of three phosphors. The three phosphor mixture consists of blue luminescing Barium Magnesium Aluminate (BAM) activated by Eu, i.e., $BaMgAl_{10}O_{17}$:Eu; red-luminescing Cerium Gadolinium Magnesium Borate (CBTM) activated by Mn, i.e., $(Ce,Gd,Tb)MgB_5O_{10}$:Mn, and 3000K-luminescing Calcium Halophosphor, also referred to as Warm White (WW) activated by Sb, Mn, i.e., $Ca_{10}(PO_4)_6(F,Cl)_2$:Sb,Mn.

Table 1 shows the particular composition of the three phosphor mixture of the Agro fluorescent lamp according to the present invention, referred to as AG in comparison to the conventional Agro fluorescent lamp, given as approximate weight percentages. Both the conventional and inventive Agro fluorescent lamps have a CRI greater than 80.

TABLE 1

| Lamp | Phosphors | Weight % |
|---|---|---|
| Conventional | Sr. Mag | 95.0 |
| | SCAP | 5.0 |
| AG | BAM | 3.59 |
| | CBTM | 42.46 |
| | WW | 53.95 |

Table 2 shows the 100 hour photometry results for three samples AG-1 to AG-3 of the inventive Agro fluorescent lamp, and a conventional Agro lamp with the two-phosphor mixture, referred to as AGRO. Columns 2 and 3 show the X and Y color point co-ordinates; column 4 shows the correlated color temperature (CCT) in degree Kelvin; and column 5 shows the lumens values for the test lamp samples.

The inventive Agro fluorescent lamp with this three-phosphor mixture exhibits higher lumens than the conventional Agro lamps with the two-phosphor mixture. As shown in Table 2, the inventive Agro fluorescent lamp provides superior lumen performance of approximately 2350 lumens, compared to approximately 1900 lumens for the conventional Agro lamp.

TABLE 2

| Lamp | X | Y | CCT | Lumens |
|---|---|---|---|---|
| AGRO | .4431 | .3593 | 2510 | 1904 |
| AG-1 | .4427 | .3603 | 2526 | 2349 |
| AG-2 | .4430 | .3613 | 2530 | 2342 |
| AG-3 | .4420 | .3603 | 2536 | 2353 |

Figure 2:
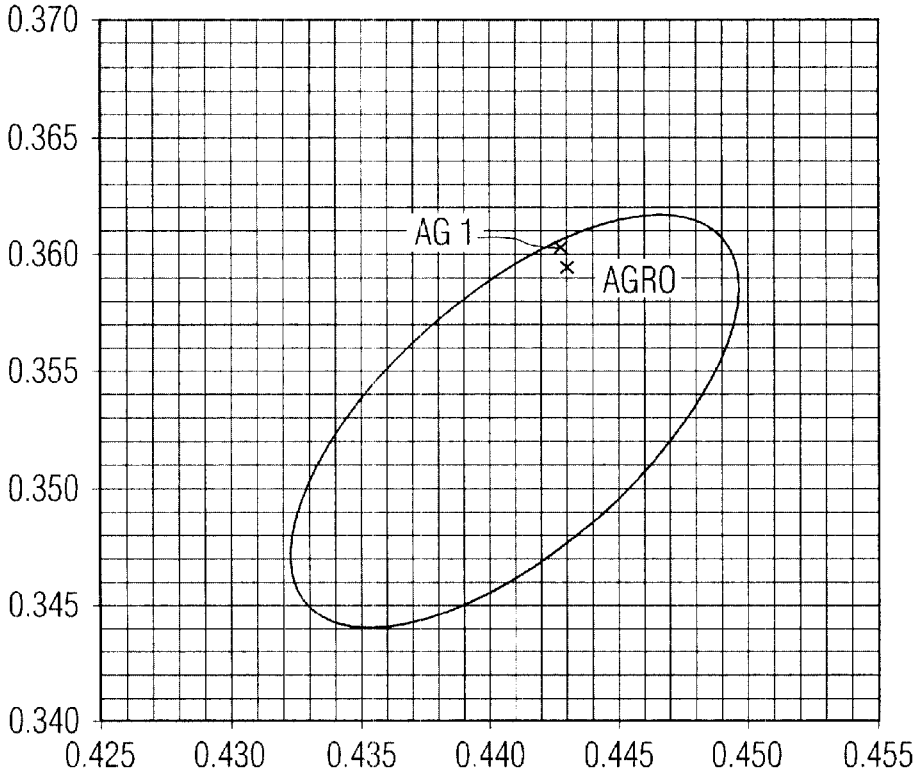
FIG. 2 shows the color acceptance criteria for the Agro fluorescent lamp according to present invention.

FIG. 2 shows the color acceptance criteria for Agro fluorescent lamps. In particular, the outermost ellipse of a four-step ellipse Agro color acceptance criteria is shown in FIG. 2. As shown in FIG. 2 and Table 2, the XY color coordinates of inventive Agro lamp falls within the outermost ellipse of FIG. 2.

Figure 3:
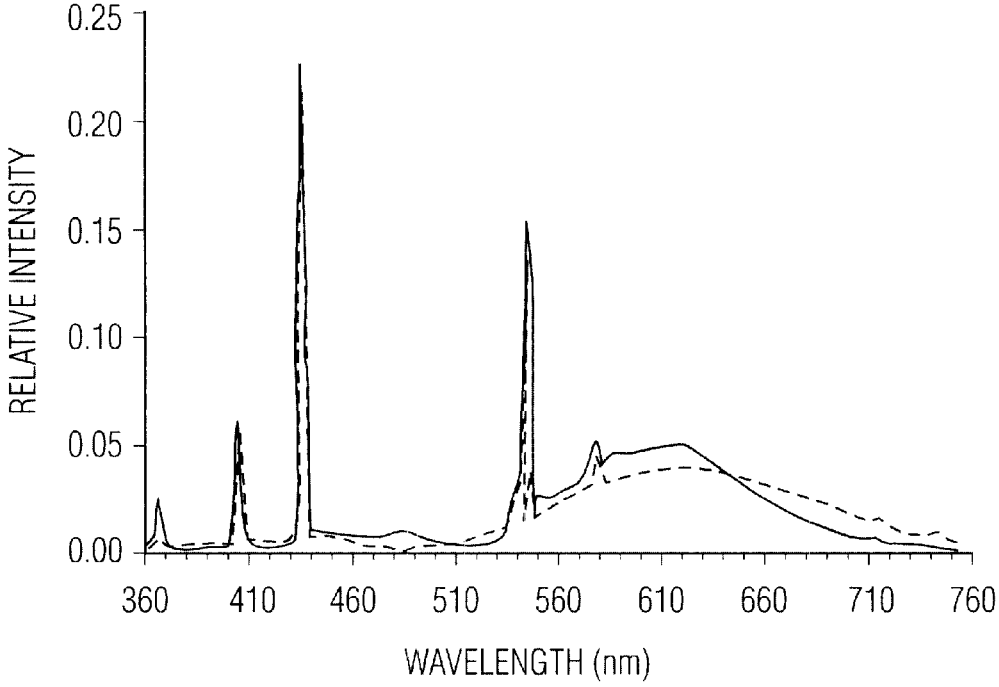
FIG. 3 shows the emission spectrum of the Agro fluorescent lamp according to the present invention.

FIG. 3 shows the emission spectrum of the inventive Agro fluorescent lamp in a solid line, and the emission spectrum of the conventional Agro fluorescent lamp in dashed lines.

The three-phosphor mixture of the inventive Agro lamp allows the lamp 100 to have reduced mercury consumption in conjunction with the alumina pre-coat 200 which shields the glass envelope 105 from mercury. In addition to the alumina pre-coat 200, the phosphor layer 210 provides lower mercury consumption than other phosphors, as well as increased brightness.

The increased brightness and reduced mercury consumption is achieved by replacing the phosphor layer of a conventional lamp with a layer of the three-phosphor mixture layer over the UV alumina pre-coat layer. In particular, the lamps used to obtain the 100 photometry results shown in Table 2 were F40T12, which are straight tubular lamps having a length of 4 feet. The raw phosphor weight used in the conventional Agro lamps was approximately 6.5±0.3 g. By contrast, the weight of the three-phosphor mixture layer 210 is considerably lower, such as approximately 6.1±0.2 g. Thus, the inventive lamps have a phosphor weight of approximately 1.475 to 1.575 grams per foot. The weight of the alumina pre-coat layer 200 is approximately 120–240 mg.

Conventional 4 ft Agro lamps are manufactured with approximately 15–40 mg of mercury. By contrast, the inventive Agro lamps with the three phosphor mixture having a length of 4 ft and a lamp life of 20,000 hours, require less than 15 mg, namely approximately 3 mg to 8 mg for lamps having a length of 8 feet or less, such as approximately 4.4 mg of mercury for 4 foot lamps, and still maintain high lumens output as listed in table 2, namely approximately 2350 lumens. Thus, the inventive lamps have approximately 1.0 to 1.1 mg of mercury per foot.

The increased light output and reduced mercury consumption are due to the superior components of the phosphor 210, as well as the UV pre-coat layer 200 which reduces the interaction of mercury ions with the glass envelope 105 and reflects the UV rays more efficiently back into the phosphor layer 210 to improve utilization of the phosphor and enhance visible light production.

While the present invention has been described in particular detail, it should also be appreciated that numerous modifications are possible within the intended spirit and scope of the invention. In interpreting the appended claims it should be understood that:

a) the word "comprising" does not exclude the presence of other elements than those listed in a claim;

b) the word "consisting" excludes the presence of other elements than those listed in a claim;

c) the word "a" or "an" preceding an element does not exclude the presence of a plurality of such elements.

d) any reference signs in the claims do not limit their scope; and e) several "means" may be represented by the same item of hardware or software implemented structure or function.

What is claimed is:

1. An electric lamp comprising:

an envelope having an inner surface and enclosing a discharge space filled with mercury;

at least one electrode for generating ultraviolet radiation in said discharge space; and a phosphor layer formed over said inner surface to convert said ultraviolet radiation to visible light;

wherein said phosphor layer is formulated to provide an output of approximately 2350 lumens, at a color temperature of approximately 2500K, said phosphor layer consisting of Barium Magnesium Aluminate, Cerium Gadolinium Magnesium Borate, and Calcium Halophosphor.

2. The electric lamp of claim 1, wherein said phosphor layer consists of approximately 3.5% weight of Barium Magnesium Aluminate, approximately 42.5% weight of Cerium Gadolinium Magnesium Borate, and approximately 54% weight of Calcium Halophosphor.

3. The electric lamp of claim 1, wherein said mercury has a weight of less than 15 mg.

4. The electric lamp of claim 1, wherein said mercury has a weight of approximately 1.0 to 1.1 mg/ft.

5. The electric lamp of claim 1, further comprising an aluminum oxide layer formed between said inner surface and said phosphor layer.

6. The electric lamp of claim 1, wherein a weight of said phosphor layer is approximately 1.475–1.575 grams per foot.

7. An electric lamp comprising:

an envelope having an inner surface and enclosing a discharge space filled with mercury having a weight of less than 15 mg;

at least one electrode for generating ultraviolet radiation in said discharge space; and a phosphor layer formed over said inner surface to convert said ultraviolet radiation to visible light;

wherein said phosphor layer is formulated to provide an output of approximately 2350 lumens, at a color temperature of approximately 2500 K, said phosphor layer consisting of Barium Magnesium Aluminate, Cerium Gadolinium Magnesium Borate, and Calcium Halophosphor.

8. The electric lamp of claim 7, wherein said phosphor layer consists of approximately 3.5% weight of Barium Magnesium Aluminate, approximately 42.5% weight of Cerium Gadolinium Magnesium Borate, and approximately 54% weight of Calcium Halophosphor.

9. The electric lamp of claim 7, wherein said weight of said mercury is approximately 1.0 to 1.1 mg/ft.

10. The electric lamp of claim 7, wherein a weight of said phosphor layer is approximately 1.475–1.575 grams per foot.

11. An electric lamp comprising:

an envelope having an inner surface;

at least one electrode for generating ultraviolet radiation within the envelope; and a phosphor layer formed over said inner surface to convert said ultraviolet radiation to visible light;

wherein said phosphor layer consists of Barium Magnesium Aluminate, Cerium Gadolinium Magnesium Borate, and Calcium Halophosphor.

12. The electric lamp of claim 11, wherein said phosphor layer consists approximately 3.5% weight of said Barium Magnesium Aluminate, approximately 42.5% weight of said Cerium Gadolinium Magnesium Borate, and approximately 54% weight of said Calcium Halophosphor.

13. The electric lamp of claim 11, further comprising mercury located within said envelope, wherein said mercury has a weight of less than 15 mg.

14. The electric lamp of claim 11, further comprising mercury located within said envelope, wherein said mercury has a weight of approximately 1.0 to 1.1 mg/ft.

15. The electric lamp of claim 11, wherein a weight of said phosphor layer is approximately 1.475–1.575 grams per foot.

16. An electric lamp comprising:

an envelope having an inner surface;

an ionizable substance in the envelope which emits ultraviolet radiation when ionized with excitation power; and a phosphor coat on said inner surface of said envelope for converting said ultraviolet radiation to visible light;

wherein said phosphor coat comprises a mixture of phosphors, said mixture consisting of Barium Magnesium Aluminate, Cerium Gadolinium Magnesium Borate and Calcium Halophosphor.

17. The electric lamp of claim 16 further comprising at least one electrode in said envelope for applying said excitation power.

18. The electric lamp of claim 16 wherein said ionizable substance comprises mercury.

19. The electric lamp of claim 18 wherein said envelope is linear in shape and wherein said mercury has a weight of approximately 1.0 to 1.1 mg/ft.

20. The electric lamp of claim 16 wherein said mixture of phosphors produces an output having a color temperature of approximately 2500 k.

21. The electric lamp of claim 16 wherein said mixture of phosphors consists of approximately 3.5% weight of Barium Magnesium Aluminate, approximately 42.5% weight of Cerium Gadolinium Magnesium Borate, and approximately 54% weight of Calcium Halophosphor.

* * * * *